United States Patent [19]

Masuda et al.

[11] Patent Number: 4,515,458

[45] Date of Patent: May 7, 1985

[54] IMAGE FORMING APPARATUS

[75] Inventors: Shunichi Masuda, Tokyo; Toshiaki Yagasaki, Hino; Yukio Kasuya, Tokyo, all of Japan

[73] Assignee: Canon Kabushiki Kaisha, Tokyo, Japan

[21] Appl. No.: 377,166

[22] Filed: May 11, 1982

[30] Foreign Application Priority Data

May 21, 1981 [JP] Japan ..... 56-75641
May 21, 1981 [JP] Japan ..... 56-75642

[51] Int. Cl.[3] ..... G03G 15/00

[52] U.S. Cl. ..... 355/3 SH; 355/14 SH; 271/289

[58] Field of Search ..... 355/3 SH, 14 SH, 3 R, 355/14 R; 271/296, 288, 290, 289

[56] References Cited

U.S. PATENT DOCUMENTS 4,222,660 9/1980 Furuichi et al. ..... 355/3 SH X
4,248,525 2/1981 Sterrett ..... 355/3 SH X
4,330,200 5/1982 Kikuchi et al. ..... 355/14 SH X
4,361,393 11/1982 Noto ..... 355/3 SH
4,368,972 1/1983 Naramore ..... 355/3 SH X
4,370,052 1/1983 Murakami et al. ..... 355/3 SH X
4,405,225 9/1983 Perrault ..... 355/3 SH X

*Primary Examiner*—A. C. Prescott
*Attorney, Agent, or Firm*—Fitzpatrick, Cella, Harper & Scinto

[57] ABSTRACT

In an image forming apparatus including a copying machine having a sorter connected thereto, the copying machine is operated in selected one of book mode or sheet mode while the sorter is operated in selected one of sorter mode and collator mode. When the sheet mode is selected for the copying machine, a control unit selects the collator mode for the sorter, and when the book mode is selected for the copying operation, the control unit selects the sorter mode for the sorter. The copying machine monitors energization status of the sorter and if the sorter is deenergized, copy papers ejected from the copying machine are prevented from being fed to the sorter.

8 Claims, 9 Drawing Figures

IMAGE FORMING APPARATUS

BACKGROUND OF THE INVENTION

1. Field of the Invention

The present invention relates to an image forming apparatus including an image forming station for forming an image on a recording medium having an application device connected thereto for handling the recording medium or an original.

2. Description of the Prior Art

A recording apparatus such as a copying machine or a laser beam printer may have an application device connected thereto such as a sorter for sorting an accommodating recording medium having images recorded thereon or an original feeding device for feeding the original to a predetermined position.

The copying machine has an operation mode (called a book mode) in which light is exposed to the original while light exposure means such as an exposure lamp is reciprocated or an operation mode (called a sheet mode) in which the light is exposed to the original while the original is moved, or a dual mode of those two operation modes.

The sorter may have a sorter mode in which recording media (called copy papers) having images formed thereon and ejected from the copying machine are sorted and accommodated in bins in such a manner that each of the copy papers having the image of the same original formed thereon is accommodated in a different bin or a collator mode in which the copy papers having the images of the same original formed thereon are accommodated in one bin.

When the sorter is connected to the dual mode copying machine to sort and accommodate the copy papers, it is advantageous to select the following mode of the sorter. When the copy operation is carried out in the book mode in the copying machine, an operator selects the operation mode of the sorter so that the copy papers fed to the sorter from the copying machine are sequentially accommodated in the different bins of the sorter for each page of the originals. When the sheet mode of the copying machine is selected, the operator selects the collator mode of the sorter because the copy papers having images of different originals formed thereon are sequentially ejected from the copying machine so that the copy papers having the images of the different originals formed thereon by the copying machine are accommodated in the same bin of the sorter.

However, the designation of such operation mode must be carried out by the operator by operating mode designation means such as keys. This is troublesome to the operator.

In the image forming apparatus including the copying machine having the application device such as the sorter connected thereto, a power to the application device is fed from the copying machine or from a power supply separate from the copying machine. In any case, for the sake of safety, means is provided to automatically cut off the power supply when a door of the application device is opened.

Accordingly, when the door of the application device is opened during the copying operation, the power supply to the application device is cut off to stop the feed of the transferred papers in the application device. However, since the power to the copying machine is continuously supplied, the copy operation and the feed of the copy papers to the application device are continued. Consequently, the copy papers fed from the copying machine to the application device are not fed into the application device but jammed sequentially resulting in damage to a number of copy papers, which in turn may cause damage to the copying machine and the application device. In addition, a post-processing for removing the jammed copy papers is troublesome.

SUMMARY OF THE INVENTION

It is an object of the present invention to provide an image forming apparatus which is not troublesome to operate and is convenient to use for an operator.

It is another object of the present invention to provide an image forming apparatus in which an accommodation mode of the copy papers is determined by designating an operation mode of an image forming unit.

It is other object of the present invention to provide an image forming apparatus in which a sorter is operated in a collator mode by designating a sheet mode of an image forming unit.

It is a further object of the present invention to provide an image forming apparatus which monitors an energization status of an application device by an image forming unit.

It is a still further object of the present invention to provide an image forming apparatus which allows the transferred papers fed from an image forming unit to an application device to be ejected to a predetermined paper bin when a power supply of the application device is cut off during an image forming operation.

The above and other objects of the present invention will be apparent from the following description of the invention.

BRIEF DESCRIPTION OF THE DRAWINGS

FIG. 1-2 shows a plan view of a control panel of the copying machine, FIG. 2 shows a block diagram of a control unit of the copying machine.

DETAILED DESCRIPTION OF THE PREFERRED EMBODIMENTS

Figure 1:
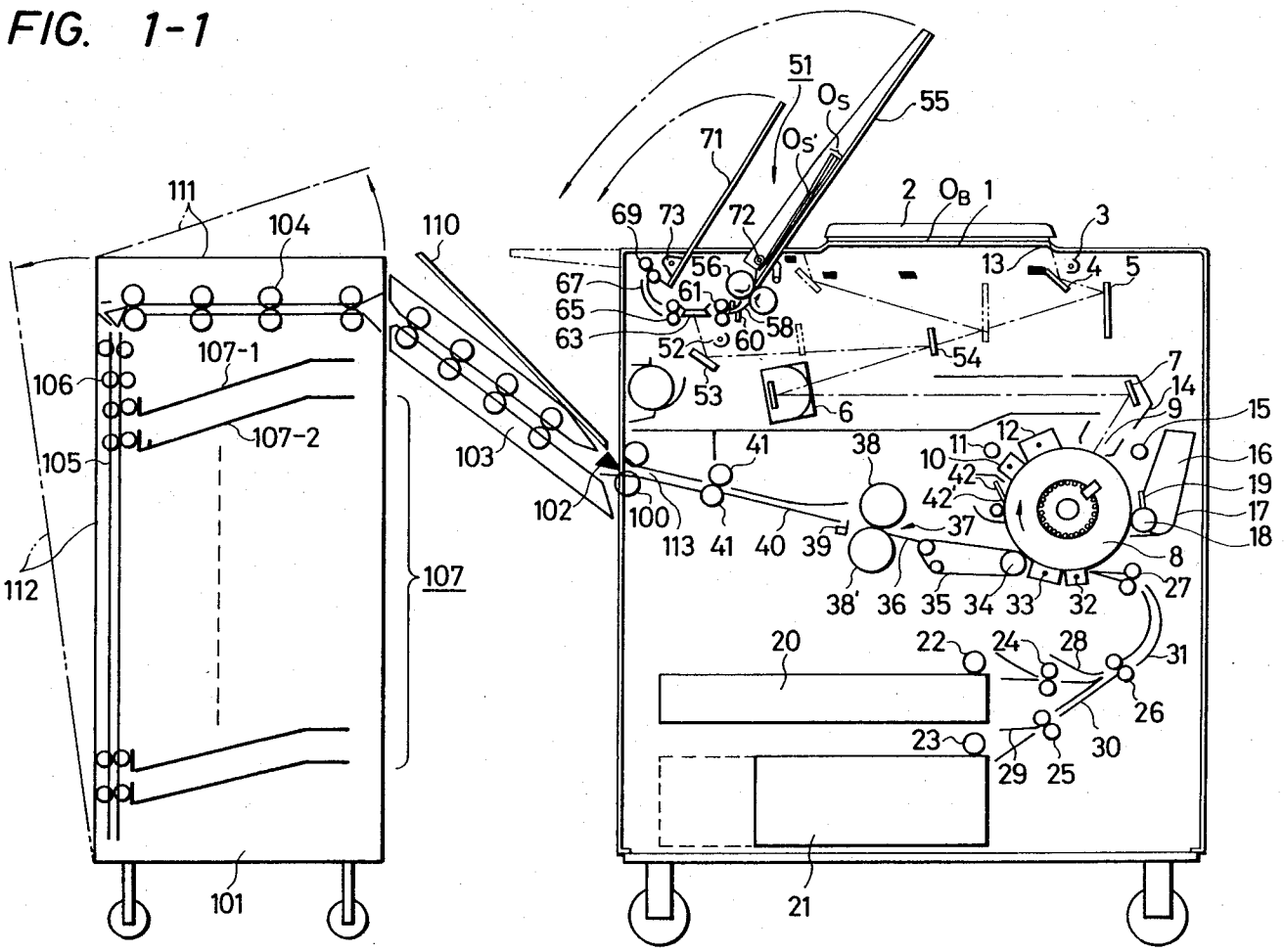
FIG. 1-1 shows a sectional view of a construction of a copying machine having a sorter connected thereto.

FIG. 1-1 shows one embodiment of the present invention in which an image forming unit is an electrophotographic copying machine of a powdered developer transfer system having an auto-feeder function.

Numeral 1 denotes an original mounting table on which an original $O_B$ to be copied is mounted. The original $O_B$ mounted on the mounting table 1 is held by an original cover 2. Arranged under the mounting table 1 are an original illumination lamp 3, movable mirrors 4 and 5, a stationary in-mirror lens 6, a stationary mirror 7 and a photosensitive drum 8. By depressing a copy button arranged on a control panel (not shown), the photosensitive drum 8 starts to rotate in a direction shown by an arrow (clockwise direction) and is subjected to charge and light exposure by chargers and lamps to be described later. The movable elements in an optical system, that is, the original illumination lamp 3 and the movable mirrors 4 and 5 move to positions shown by broken lines. When the photosensitive drum 8 completes a predetermined amount of rotation, the light exposure starts so that the original illumination lamp 3 and the movable mirror 4 are moved rightward from the broken line positions at the same velocity as a circumferential velocity of the photosensitive drum 8 and the movable mirror 5 is moved rightward from the broken line position at one-half velocity of the circumferential velocity. An image of the original $O_B$ illuminated by the original illumination lamp 3 is focused to the photosensitive drum 8 at an exposure station 9 by the optical system including the movable mirrors 4 and 5, the in-mirror lens 6 and the mirror 7. When the light exposure is terminated, the original illumination lamp 3 and the movable mirrors 4 and 5 stop their rightward movements and immediately start reverse (leftward) movements.

The above operation is repeated by the number of copies preset by a number of copy setting key (not shown) arranged on the control panel. When the light exposure is completed by the preset number of copies, the original illumination lamp 3 and the movable mirrors 4 and 5 are returned to the solid line positions and stop there. The velocity of the leftward movement of the original illumination lamp 3 is faster than that of the rightward movement to increase an efficiency of the copy operation.

The photosensitive drum 8 has a photosensitive layer covered with a transparent insulative layer and it rotates clockwise as described above. As it rotates, the photosensitive drum 8 is first AC-discharged by an AC predischarger to which an AC high voltage is supplied from a high voltage power supply (not shown) and exposed by a lamp 11 so that charges on the insulative layer and in the photosensitive layer are discharged. Then, it is positively charged by a primary charger 12 to which a positive high voltage is supplied from the high voltage power supply. At the light exposure station 9, the image from the illumination station 13 is slit-exposed and the photosensitive drum 8 is AC-discharged by an AC discharger 14 to which an AC high voltage is supplied from the high voltage power supply. Then, flat exposure is carried out by a lamp 15 to form an electrostatic latent image on the surface of the photosensitive drum 8. At a developing station, a developer 16 has a container 17 for developing material, a developing roll 18 and a doctor blade 19 and develops the electrostatic latent image on the photosensitive drum 8 by the developing material magnetically attracted to the developing roll 18.

On the other hand, copy papers P are accommodated in a paper cassette 20 or a paper feed deck 21 mounted at the bottom of the copying machine. Various cassettes 20 are prepared for various sizes of the copy papers and are exchangeable as required. One of several different sizes of copy papers can be accommodated in the paper feed deck 21 by a simple operation. The copy papers P accommodated in the cassette 20 and the paper feed deck 21 are pressed by paper feed rolls 22 and 23, respectively, at a predetermined pressure. When the photosensitive drum 8 rotates to a predetermined position, the paper feed roll 22 or 23 starts to rotate to feed the copy paper P rightward. The copy paper P thus fed out of the cassette 20 or the paper feed deck 21 is conveyed by a roll pair 24 or 25, roll pairs 26 and 27, a guide 28 or 29 and guides 30 and 31 to the photosensitive drum 8. It is then timed with the image on the photosensitive drum 8 and contacted with the photosensitive drum 8. It is then charged by a transfer charger 32 to which a positive high voltage is supplied from the high voltage power supply so that the image on the photosensitive drum 8 is transferred to the copy paper P. The transferred copy paper P is then discharged by a separation discharger 33 to which an AC high voltage is supplied from the high voltage power supply to weaken the attraction force by the photosensitive drum 8. The copy paper 9 is then pulled out by a roll 34 to separate from the photosensitive drum 8 and guided to a fixing station 37 by a belt 35 and a guide 36. At the fixing station 37, the unfixed image on the copy paper P is pressed at a predetermined pressure and fixed while it passes through a pair of rolls 38 which are pressed to each other at a predetermined pressure and rotated at the same circumferential velocity. The charges remaining on the copy paper P from the fixing station are discharged by a discharger 39 and the copy paper P is guided to ejection rolls 41 and 100 by a guide 40 and ejected to a non-sort tray 110.

After the transfer operation, the developing material remaining on the photosensitive drum 8 is removed by an edge 42' of a blade cleaner 42 and the photosensitive drum 8 repeats the next cycle. After the cycle has been repeated by the preset number of copies, the photosensitive drum 8 further continues to rotate to discharge the charges in the photosensitive layer by the AC discharger 14 and the flat exposure by the lamp 15, and stops after a predetermined amount of rotation to be ready for the next cycle of operation.

A numeral 51 denotes an auto-feeder for feeding the original to the exposure station. The copy operation by the auto-feeder, that is, the sheet mode copy operation is now explained. An auto-feeder optical system comprises an original illumination lamp 52, a stationary mirror 53 and a movable mirror 54 arranged as shown. When the auto-feeder is used, the original illumination lamp 3 and the movable mirrors 4 and 5 described above are stopped at the solid line positions and the auto-feeder movable mirror 54 is moved rightward from a first broken line position and stopped at a second solid line position. Thus, an auto-feeder optical path is formed by the auto-feeder original illumination lamp 52, the mirror 53, the movable mirror 54, the in-mirror lens 6 and the stationary mirror 7.

When a stack $O_S$ of original sheets is mounted on the original sheet insert table 55, the topmost original sheet $O_S'$ is separated by a separation and feed roll pair 56 which rotate oppositely to each other to feed the original sheet to a guide 58. When a leading edge of the original sheet $O_S'$ is sensed by a sensor 60, the original sheet $O_S'$ is stopped. When the photosensitive drum 8 is rotated to a predetermined position, the original sheet $O_S'$ is conveyed past a guide glass 63 by the roll pair 56 and a roll pair 61 in synchronism with the rotation of the photosensitive drum 8, and illuminated by the lamp 52. An image of the original sheet $O_S'$ is focused to the photosensitive drum 8 by the mirror 53, the movable mirror 54, the in-mirror lens 6 and the stationary mirror 7. Then, the original sheet $O_S'$ is fed to an original tray 71 by a roll pair 65, a guide 67 and an ejection roll pair 69. This operation is continued until the original sheets $O_s$ on the original sheet insert table 55 are exhausted.

The original sheet insert table 55 and the original tray 71 are pivotably supported by a shaft 72 and a shaft 71, respectively, to allow counterclockwise rotations thereof and they are fixed at the solid line positions by stoppers (not shown) when the auto-feeder is used. When the auto-feeder is not used, they are rotated counterclockwise to the broken line positions so that they may be used as a working table. By the use of the auto-feeder, a long size original can be copied. Therefore, in the present embodiment, the large size cassette 20 is used. The large size cassette 20 is mounted at an area of the copying machine which is expanded by the addition of the auto-feeder to eliminate a wasteful space in the copying machine.

The operation of the copying machine has so far been described. The operation of the sorter 101 connected to the copying machine is now explained. The copy papers P ejected from the ejection roll 100 of the copying machine are ejected to the non-sort tray 110 or a bridge mechanism 103 which feeds the papers to the sorter 101, by an ejection selection lever 102. When a sorter selection key on the control panel is depressed, the selection lever 102 is operated to feed the copy papers P to the bridge mechanism 103. As a result, the copy papers P ejected from the copying machine pass through the bridge mechanism 103 and are fed to a paper accommodation path 105 by a sorter drive roll 104, and sequentially accommodated in accommodation trays 107 by bin shift rolls 106.

The sorter can be operated in one of two modes when it distributes and accommodates the copy papers P. The first mode is the sorter mode in which a series of copy papers P which are fed from the copying machine and have the same original image transferred thereon are accommodated in different bins for each copy paper. The second mode is the collator mode in which the series of copy papers P fed from the copying machine are accommodated in one bin. As will be described later, when the sheet mode is selected for the copying machine, the sorter 101 is operated in the collator mode. When either door 111 or 112 of the sorter 101 is opened as shown by arrows during the operation of the sorter 101, a door switch is turned off to cut off the power supply to the sorter 101, as will be explained later.

Figures 1, 2:
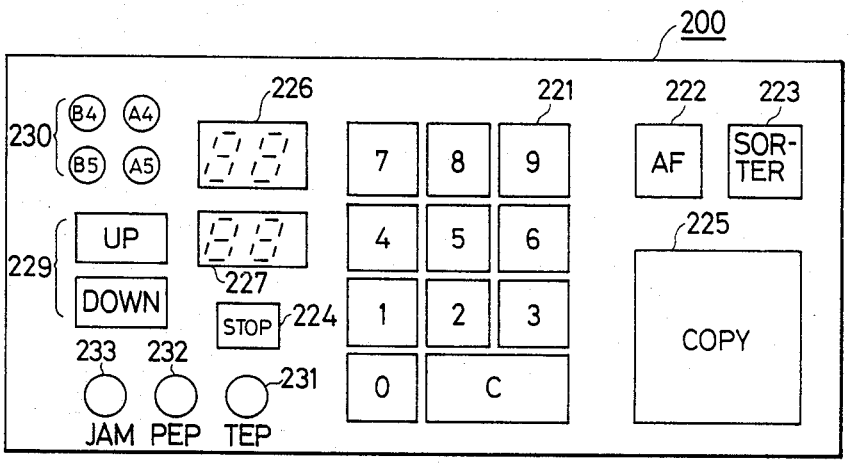
Figure 2:
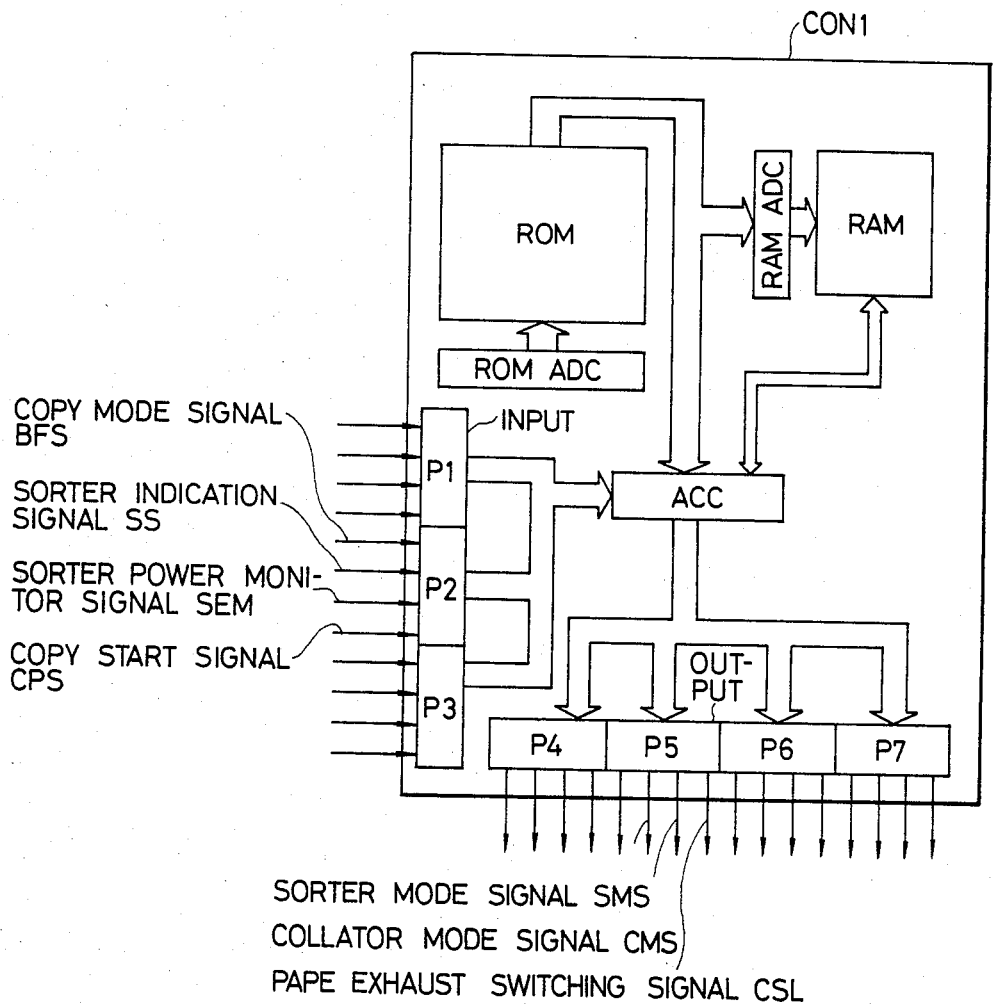

FIG. 1-2 shows the control panel 200 of the copying machine. Numeral 221 denotes a ten-key for setting a desired number of copies. By depressing numeric keys 0–9, the number of copies up to 99 can be set in a display 226. A clear key C is used to reset the content of the display 226 to zero. Numeral 222 denotes a mode key which is used when the auto-feeder is to be used. By depressing the key 222, the use of the auto-feeder 51 is permitted. Numeral 223 denotes a key which is used when the sorter 101 is to be used. By depressing the key 223, the use of the sorter 101 is permitted. Numeral 224 denotes a stop key which is used to stop the machine before the count of copies reaches the preset number of copies. By depressing the stop key 224, the copy cycle is terminated after the current copy operation has been completed. Numeral 225 denotes a start key for starting the copy operation. Numerals 226 and 227 denote 7-segment displays constructed by light emitting diodes or liquid crystal display devices and display the preset number of copies and the copy count, respectively. Numeral 229 denotes keys for selecting the paper feed cassette 20 and the paper feed deck 21 respectively, numeral 230 denotes displays for displaying the paper size in the cassette 20 selected by the key 229, numeral 231 denotes a lamp which is lit when the toner in the developer 16 is empty, numeral 232 denotes a lamp which is lit when the papers in the selected cassette or deck are empty, and numeral 233 denotes a lamp when the paper is jammed. The keys 222 and 223 include lamps therein which are lit when the keys are depressed.

Figure 3:
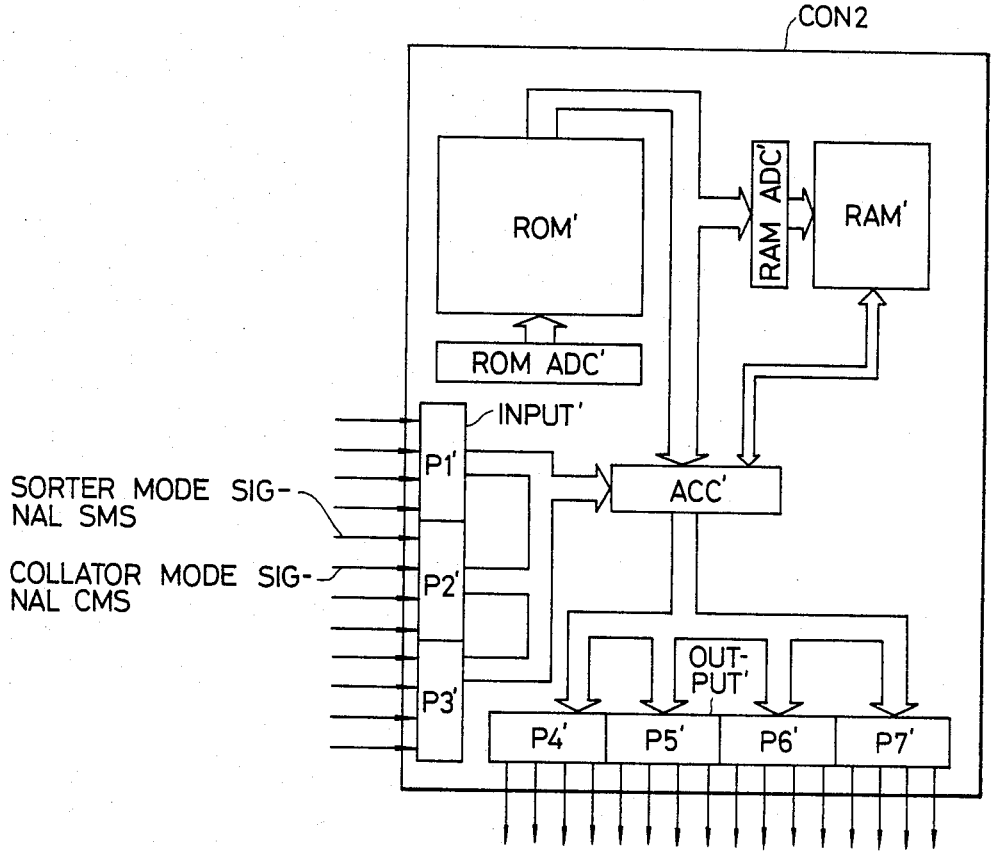
FIG. 3 shows a block diagram of a control unit of the sorter.

FIGS. 2 and 3 show configurations of control circuits CON 1 and CON 2 constructed by 4-bit microcomputers for controlling the operations of the copying machine and the sorter, respectively. Referring to FIG. 2, ROM denotes a read-only memory, and RAM denotes a random access memory. Signals applied to an input port INPUT comprising ports P1–P3 are supplied to an accumulator ACC, which reads out a program and data from the read-only memory ROM and the random access memory RAM based on the input signals to carry out desired operation and control and supplies control signals to a load through an output port OUTPUT comprising ports P4–P7.

In FIG. 3, ROM', RAM' and ACC' denote a read-only memory, a random access memory and an accumulator, respectively, and INPUT' denotes an input port comprising ports P1'–P3' and OUTPUT' denotes an output port comprising ports P4'–P7'.

Applied to the input port P2 of the control circuit CON 1 is a copy mode signal BFS which is produced by depressing the key 222. The signal BFS is "1" when the key 222 is depressed to select the auto-feeder 51 and the sheet mode. A sorter selection signal 55 which is produced when the key 223 is depressed is also applied to the input port P2, a sorter energization monitor signal SEM which indicates the energization status of the sorter 101 and a copy start signal which is produced by depressing the copy key 225 are also applied.

A sorter mode signal SMS for operating the sorter 101 in the sorter mode, a collator mode signal CMS for operating the sorter 101 in the collator mode and a copy paper ejection selection signal CSL for selecting the ejection selection lever 102 are produced from the output port P5.

The sorter mode signal SMS and the collator mode signal CMS are also applied to the input port P2' of the sorter control circuit CON 2.

In the present embodiment, those input/output signals of the control circuits CON 1 and CON 2 which are not directly related to the operation of the embodiment are omitted.

Figure 4:
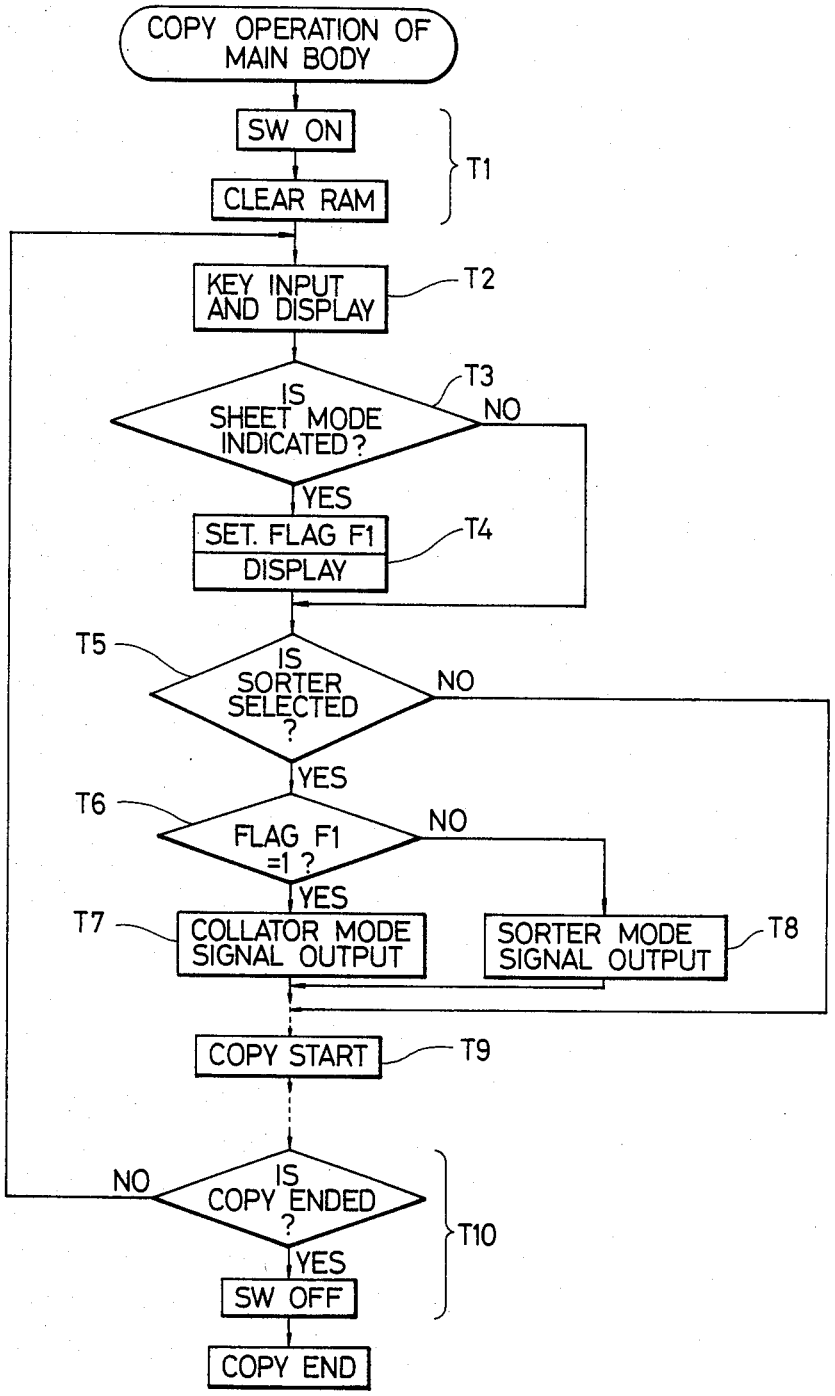
FIG. 4 shows a flow chart for explaining a control operation in which an operation mode of the sorter is determined by designating an operation mode of the copying machine.

Referring to a flow chart of FIG. 4, the control operation of the present embodiment is now explained.

When a power switch of the copying machine is turned on to turn on the power supply, the random access memory RAM is cleared (step T1). The number of copies is set by depressing keys on the control panel 200 of the copying machine (step T2). When the key 222 is depressed to select the auto-feeder 51 and the sheet mode, the "1" copy mode signal BFS is supplied from the control panel 200 to the input port P2. In a step T3, the signal BFS is checked, and if it is "1" a flag F1 in the random access memory RAM is set to "1" and the lamp in the key 222 is lit to indicate the selection of the sheet mode (step T4), and the process goes to a step T5. If the signal BFS is "0", the selection of the book mode is determined and the process jumps to the step T5. In the step T5, the depression of the sorter selection key 223 is checked. If the sorter selection key 223 is depressed, the "1" sorter selection signal SS is supplied from the control panel 200 to the input port P2, and the lamp in the key 223 is lit to indicate the selection of the sorter. In a step T6, the flag F1 is checked to determine if the sheet mode has been selected. If the flag F1 is "1", it is determined that the sheet mode has been selected and the process goes to a step T7, in which the collator mode signal CMS for operating the sorter 101 in the collator mode is supplied from the output port P5 to the input port P2' of the control circuit CON 2 of the sorter 101. If the flag F1 is "0", it is determined that the book mode has been selected and the process goes to a step T8, in which the sorter mode signal SMS for operating the sorter 101 in the sorter mode is supplied from the output port P5 to the input port P2' of the control circuit CON2. In this manner, when the copying machine is in the sheet mode, the sorter 101 is set in the collator mode, and when the copying machine is in the book mode, the sorter 101 is set to the sorter mode.

After the mode selection, the copy operation is started in a well known manner in accordance with the copy instructions such as the number of copies, a density of the copy and the size of copy papers from the control panel of the copying machine (step T9), and the transferred copy papers are fed to the sorter 101 and accommodated in the accommodation bins 107 of the sorter 101 in the collator mode or the sorter mode. When the preset number of copies have been made, an operator turns off a main switch to terminate the copy operation (step T10).

Figure 5:
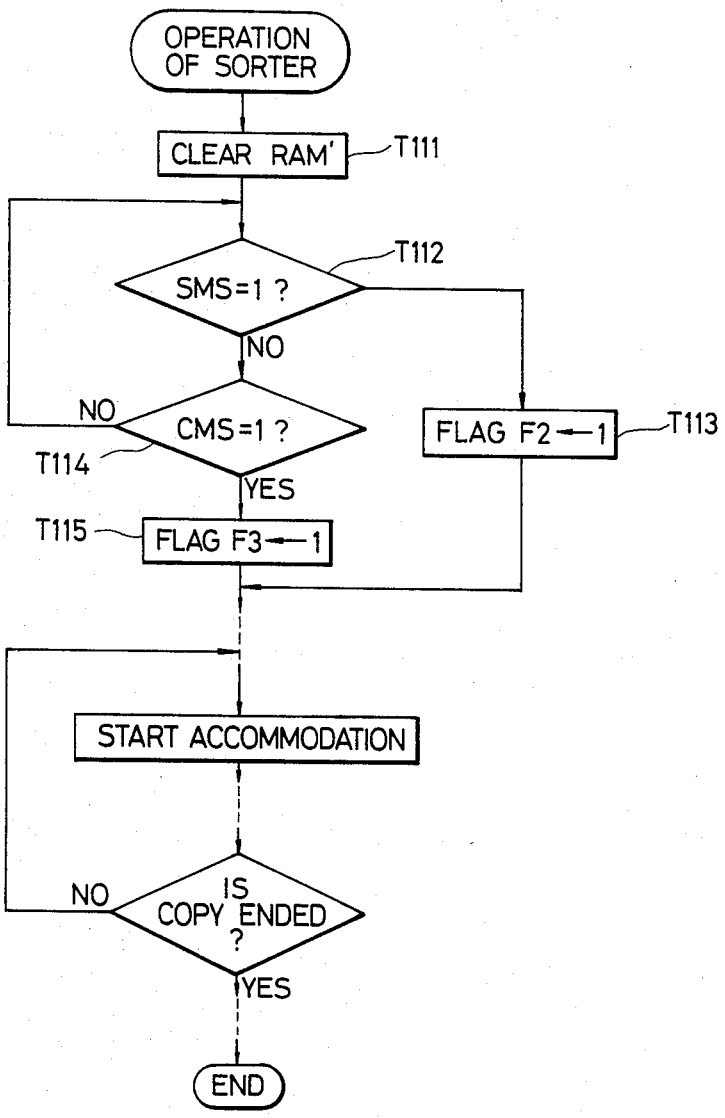
FIG. 5 shows a flow chart for explaining a control operation of the sorter.

Referring to FIG. 5, the operation of the sorter 101 when the collator mode signal CMS or the sorter mode signal SMS is supplied from the copying machine is now explained.

When the power supply of the copying machine is turned on and the sorter selection key is depressed (steps T1 and T5 in FIG. 4), the power supply of the sorter 101 is turned on. In a step T111, the random access memory RAM' is cleared and the sorter mode signal SMS which is supplied from the copying machine to the input port P2' to select the sorter mode of the sorter 101 is checked (step T112), and if it is "1", a sorter selection flag F2 in the random access memory RAM' is set to "1" (step T113). On the other hand, if the "1" collator mode signal CMS to select the collator mode is supplied to the input port P2' (step T114), a collator selection flag F3 is set to "1" (step T115). When neither the "1" sorter mode signal SMS nor the "1" collator mode signal CMS is supplied from the copying machine, it is determined that the sorter 101 is not selected and the process goes back to the step T112 to wait for the input of the sorter mode signal SMS or the collator mode signal CMS from the copying machine.

After the operation mode of the sorter 101 has been selected by the instruction from the copying machine, the copy key 225 of the copying machine is depressed, and when the signal CPS changes to "1", the copying operation is started and the drive motor of the sorter 101 is energized. Thus, the copy papers P fed from the copying machine are accommodated in the accommodation trays 107 of the sorter 101 in the selected mode (sorter mode or collator mode).

In the present embodiment, when the copying machine operates in the book mode, the sorter mode signal SMS is supplied from the copying machine to the sorter 101 as described above. In response to the signal SMS, the sorter 101 selects the sorter mode. As a result, the copy papers P fed from the copying machine to the paper accommodation path 105 are sequentially accommodated in the accommodation trays 107-1, 107-2, 107-3, . . . , one at a time in this order. If the copying machine uses the auto-feeder and selects the sheet mode copy operation, the collator mode signal CMS is supplied from the copying machine to the sorter 101 so that the sorter 101 selects the collator mode. In this case, the copy papers P in one copy operation for the topmost original $O_s$ mounted on the original sheet insert table 55 are accommodated in the same accommcdation tray 107-1. The copy papers P in the next copy operation are accommodated in the next tray 107-2. Similarly, the copy papers P in each of a series of copy operations by the auto-feeder are accommodated in the same accommodation tray.

By operating the sorter 101 in the collator mode when the copying machine is operated in the sheet mode and in the sorter mode when the copying machine is operated in the book mode, the operator need not designate the operation mode of the sorter 101 by the control panel as is required in the prior art machine and hence the operability of the machine is improved.

While the image forming apparatus including the dual mode copying machine having the sorter connected thereto has been shown and described, the present invention is not limited to such an image forming apparatus. For example, in an image forming apparatus including a laser beam printer having a sorter connected thereto, when a number of prints are to be simultaneously formed from one of a plurality of image data, the print papers are accommodated in the sorter mode, and when one print is to be formed from one image data and the above operation is to be repeated for each of the image data, the print papers are accommodated in the collator mode.

In a copying machine having an automatic original feed device for feeding the original to the exposure station, stopping the original there and ejecting the original after a preset number of times of exposure operation have been completed, the collator mode is selected when the preset number of copies is one.

As described above, the sorter 101 has the door switch which is turned off to cut off the power supply to the sorter 101 when the door 111 or 112 is opened during the operation.

Figure 6:
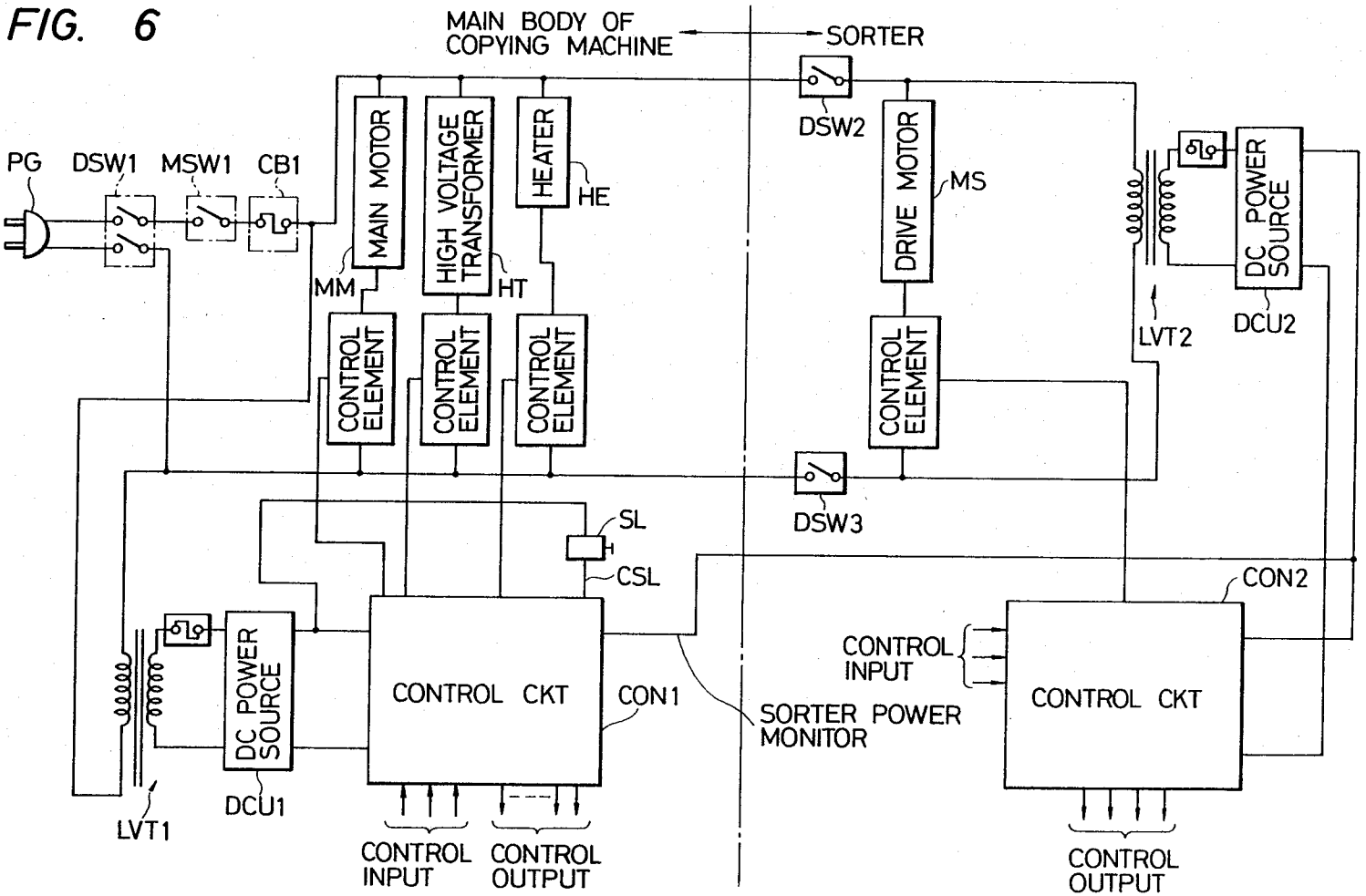
FIG. 6 shows a block diagram of a power supply circuit of the copying machine and the sorter.

FIG. 6 shows a circuit diagram therefor. In the copying machine, an AC power is supplied from a plug PG to a controller main motor MM, a high voltage transformer HT and a heater HE through a door switch DSW 1, a main switch MSW 1 and a main circuit breaker CB 1. LVT 1 denotes a transformer which transforms the AC voltage supplied from the plug PG and supplies the transformed voltage to a DC power supply DCU 1, which in turn supplies a stabilized DC voltage to the control circuit CON 1 shown in FIG. 2.

On the other hand, in the sorter 101, a power is supplied through the door switch DSW 1 and the main switch MSW 1 of the copying machine, and it is supplied to a drive motor MS and a DC power supply transformer LVT 2 through sorter door switches DSW 2 and DSW 3 which correspond to the doors 111 and 112, respectively. The door switches DSW 2 and DSW 3 are turned on and off when the doors 110 and 111, respectively, are closed and opened. The output voltage from the transformer LVT 2 is converted to a DC voltage by a DC power supply DCU 2 and the DC voltage is supplied to the control circuit CON 2 and other control circuits (not shown).

The DC voltage supplied from the DC power supply DCU 2 of the sorter 101 to the control circuit CON 2 is fed to the input port P2 of the control circuit CON 1 of the copying machine to check if the sorter 101 is energized or not. When the control circuit CON 1 detects that the sorter 101 is deenergized, it supplies the copy paper ejection selection signal CSL from the output port P5 to an ejection selection solenoid, which in turn responds to the signal CSL from the control circuit CON 1 to actuate the ejection selection lever 102 (FIG. 1-1) so that the copy papers P ejected from the copying machine are ejected to the non-sort tray 110.

Figure 7:
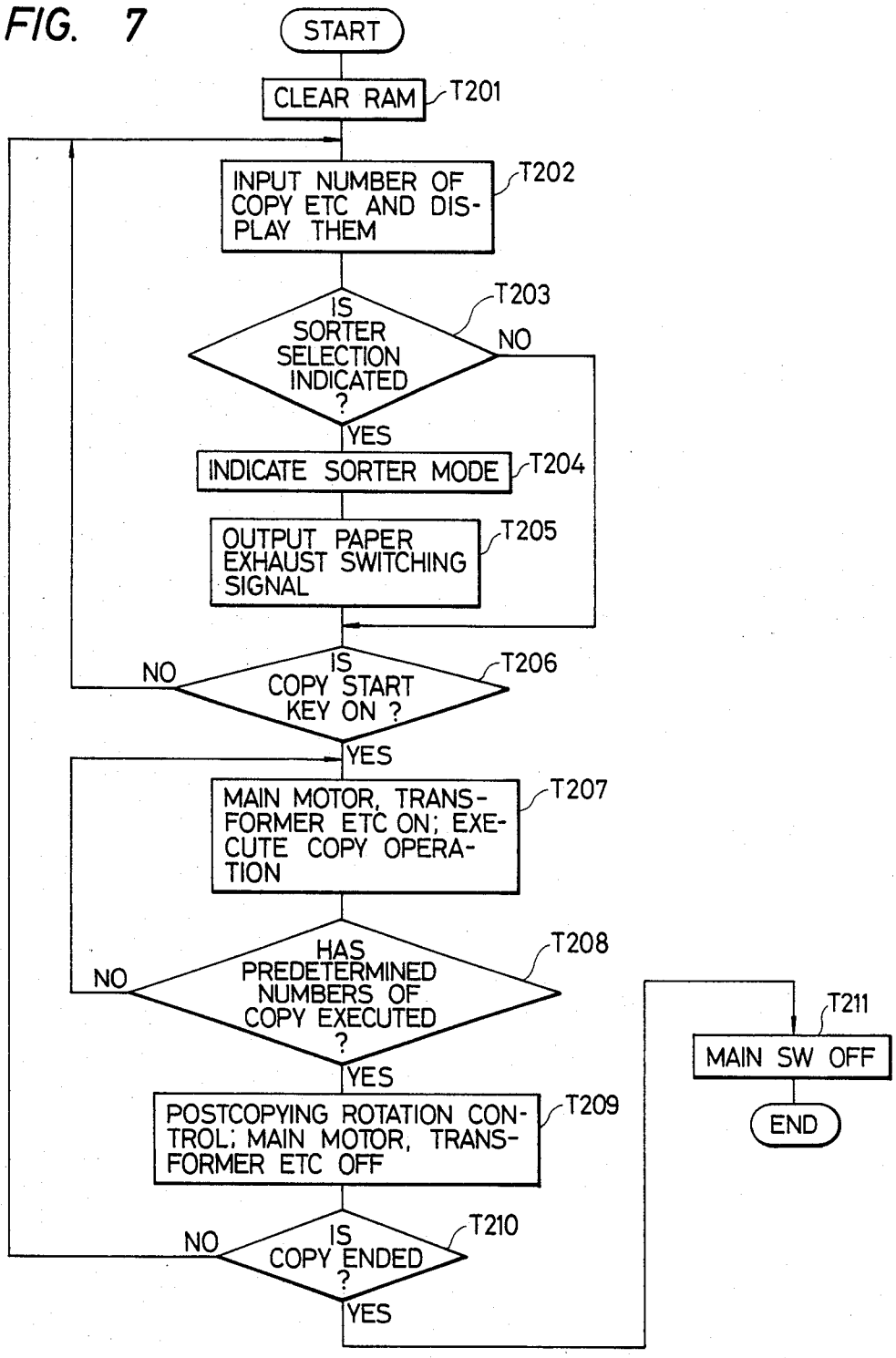
FIGS. 7 and 8 show flow charts for explaining a control operation of the copying machine when a door switch of the sorter is opened.

Referring to a flow chart of FIG. 7, the control operation of the present embodiment is explained.

When the main switch MSW 1 is turned on, the copying machine and the sorter 101 are powered on. In the copying machine, the random access memory RAM of the control circuit CON 1 is cleared (step T201). The number of copies and the copy mode are set by the keys on the control panel 200 and the input data are stored in the random access memory RAM and the input number of copies is displayed on the display arranged in the control panel (step T202). It is checked if the sorter is selected by the sorter selection key 223 (step T203). If the sorter is selected, the operation mode of the sorter (collator mode or sorter mode) is selected by the signal from the key 222 which selects the auto-feeder 51 (step T204), and the copy paper ejection selection signal CSL is supplied from the output port P5 of the control circuit CON 1 to the ejection selection solenoid (step T205). When the signal CSL is supplied to the ejection selection solenoid, it actuates the ejection selection lever 102 which is arranged to eject the copy papers P ejected from the ejection station 113 to the non-sort tray 110 so that the copy papers P are ejected to the bridge mechanism 103. In a step T206, the process waits until the copy key 225 is depressed and the copy start signal CPS is changed to "1" to start the copy operation. On the other hand, if the sorter 101 is not selected, the process jumps from the step T203 to the step T206.

In the step T206, when the copy start signal CPS is detected by the depression of the copy start key on the control panel 200, the process goes to a step T207, in which the main motor MM and the transformer HT are energized under the control of the control circuit CON 1 to start the copy operation. The transferred copy paper P is fed from the ejection station 113 to the sorter 101 through the bridge mechanism 103 when the sorter is selected, and ejected to the non-sort tray 110 when the sorter is not selected. The copy operation is repeated by the number of times preset in the step T202, and when the preset number of times of copy operations are detected in a step T208, the photosensitive drum 8 is post-rotated (step T209) and then the main motor MM and the transformer HT are deenergized. In a step T210, when the operator determines the end of the copy operation and turns off the main switch MSW 1 (step T211), the copying machine is powered off and stops the operation. If the main switch MSW 1 is not turned off, the process goes back to the step T202 to wait for a subsequent key signal.

The operation when the door 111 or 112 of the sorter 101 is opened during the copy operation of the copying machine is now explained. When the door 111 or 112 is opened, the door switch DSW 2 or DSW 3 is turned off so that the power supplied from the copying machine to the sorter 101 is cut off. The control circuit CON 1 of the copying machine monitors the energization status of the sorter 101, and when it senses the deenergization of the sorter 101, it interrupts the copy operation of the copying machine shown in FIG. 7 and executes a control operation subroutine SUB shown in FIG. 8.

Figure 8:
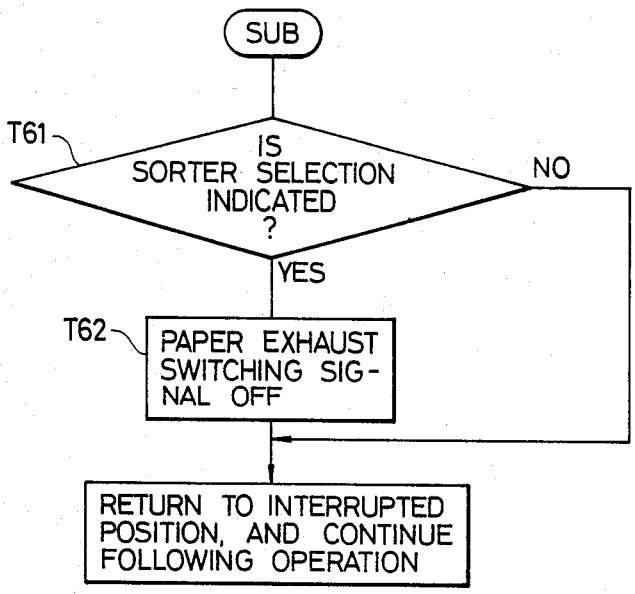

In FIG. 8, the sorter selection is checked by the sorter selection signal SS (step T61). If the sorter is selected, the process goes to a step T62 in which the copy paper ejection selection signal CSL supplied from the control circuit CON 1 to the solenoid is turned off. When the signal CSL is turned off, the solenoid releases the ejection selection lever 12 which has been actuated so far to return it to the non-actuated position. As a result, the copy papers P ejected from the ejection station 113 of the copying machine are ejected to the non-sort tray 110. After the lever position has been switched, the process goes back to the step at which the copy operation of FIG. 7 was interrupted to continue the following steps. On the other hand, when the sorter is not selected, the process skips the step T62 from the step T61 and continues the following steps. When the door switch DSW 2 or DSW 3 of the sorter 101 is opened and again closed, the copy papers P are ejected to the non-sort tray 110.

As described hereinabove, according to the present embodiment, the energization status of the power supply of the sorter is monitored in the copying machine, and if the power supply of the sorter is turned off to stop the accommodation operation of the copy papers, the copy papers ejected from the copying machine are prevented from being fed to the sorter. Accordingly, the copy papers are not jammed when the sorter is deenergized during the copy operation and no troublesome post-handling is required.

While the image forming apparatus including the copying machine having the sorter connected thereto has been shown and described, the present invention is not limited to such an image forming apparatus but it can be equally applicable to other image forming apparatus including a copying machine with a stepple function having a steppler connected thereto.

While the operation of the copying machine is continued when the door of the sorter is opened in the present embodiment, the power to the sorter may be supplied without routing the door switch of the copying machine to allow the continued operation of the sorter when the door of the copying machine is opened during the copying operation to complete the accommodation operation of the copy papers already conveyed to the sorter.

What is claimed is:

1. An image forming apparatus comprising:

an image forming unit for forming an image on a record medium, said image forming unit being operable in selected one of two different operation modes to form the image on said record medium, said operation modes of said image forming apparatus comprising a first mode for exposing while an original is moved and a second mode for exposing while the original is fixed;

an accommodation unit having a plurality of bins for distributing and accommodating therein record medium fed from said image forming unit, said accommodation unit being operable in selected one of two different operation modes to distribute and accommodate said record medium, said operation modes of said accommodation unit comprising a collator mode for accommodating the record medium sequentially in one bin and a sorter mode for accommodating the record medium in different bins for each record medium; and control means for selecting the operation mode of said accommodation unit in accordance with the operation mode selected for said image forming unit, wherein said control means selects said collator mode for said accommodation unit when said first mode is selected for said image forming unit.

2. An image forming apparatus comprising:

an image forming unit for forming an image on a record medium, said image forming unit being operable in selected one of a first image forming mode for forming an image of one original on one record medium in one cycle and a second image forming mode for forming an image of one original on a plurality of record medium in one cycle;

a record medium accommodation unit having a plurality of bins for distributing and accommodating therein the record medium fed from said image forming unit, said record medium accommodation unit being operable in selected one of a first accommodation mode for accommodating the record medium sequentially fed from said image forming unit in one bin and a second accommodation mode for accommodating the record medium sequentially fed from said image forming unit in different bins for each record medium; and control means adapted to select the operation mode such that in either one of said first and second image forming modes and said first and second accommodation modes, if either of the first and second modes is selected, either of the first and second modes in either other of said two kinds of modes is selected.

3. An image forming apparatus comprising:

an image forming unit for forming an image on a record medium, said image forming unit being operable in selected one of a first image forming mode for forming an image of one original on one record medium in one cycle and a second image forming mode for forming an image of one original on a plurality of record medium in one cycle;

a record medium accommodation unit having a plurality of bins for distributing and accommodating therein the record medium fed from said image forming unit, said record medium accommodation unit being operable in selected one of a first accommodation mode for accommodating the record medium sequentially fed from said image forming unit in one bin and a second accommodation mode for accommodating the record medium sequentially fed from said image forming unit in different bins for each record medium; and control means responsive to the selection of said first image forming mode in said image forming unit to select said first accommodation mode for said record medium accommodation unit.

4. An image forming apparatus according to claim 3 wherein said image forming unit includes reciprocating means for illuminating an original, said reciprocating means illuminates said original in said second image forming mode.

5. An image forming apparatus according to claim 3 or 4 wherein said image forming unit includes original feeding means for feeding the original to an exposure station for exposure, said original feeding means feeds said original to said exposure station in said first image forming mode.

6. An image forming apparatus according to claim 5 wherein said original feeding means feed said original to said exposure station, exposes while moving the original and ejects the original.

7. An image forming apparatus according to claim 6 wherein said original feeding means includes a mounting table for receiving a plurality of originals and feeds the originals from said mounting table one at a time.

8. An image forming apparatus according to claim 4 wherein original illumination means is reciprocated by said reciprocating means.

* * * * *